US008505979B2

(12) United States Patent
Yrjonen

(10) Patent No.: US 8,505,979 B2
(45) Date of Patent: Aug. 13, 2013

(54) METHOD FOR PRODUCING A DATA CARRIER AND DATA CARRIER PRODUCED THEREFROM

(75) Inventor: Tapio Yrjonen, Helsinki (FI)

(73) Assignee: Gemalto Oy, Vantaa (FI)

( * ) Notice: Subject to any disclaimer, the term of this patent is extended or adjusted under 35 U.S.C. 154(b) by 1203 days.

(21) Appl. No.: 12/307,234

(22) PCT Filed: Jul. 5, 2007

(86) PCT No.: PCT/EP2007/056844

§ 371 (c)(1),
(2), (4) Date: Dec. 31, 2008

(87) PCT Pub. No.: WO2008/003762

PCT Pub. Date: Jan. 10, 2008

(65) Prior Publication Data

US 2009/0310470 A1 Dec. 17, 2009

(30) Foreign Application Priority Data

Jul. 7, 2006 (EP) ..... 06014108

(51) Int. Cl.
*B42D 15/00* (2006.01)
*B42D 15/10* (2006.01)
*G03C 3/00* (2006.01)

(52) U.S. Cl.
USPC ..... 283/72; 283/94; 430/10; 430/15

(58) Field of Classification Search
USPC ..... 283/72, 904; 430/10, 15
See application file for complete search history.

(56) References Cited

U.S. PATENT DOCUMENTS 4,765,656 A * 8/1988 Becker et al. ..... 283/904
4,766,026 A * 8/1988 Lass et al. ..... 283/904
6,179,338 B1 * 1/2001 Bergmann et al. ..... 283/86

(Continued)

FOREIGN PATENT DOCUMENTS

DE 196 31 283 A1 2/1998
GB 2 111 910 A 7/1983

(Continued)

OTHER PUBLICATIONS

Form PCT/ISA/210 (International Search Report) dated Aug. 31, 2007.
Form PCT/ISA/237 (Written Opinion of the International Searching Authority) dated Aug. 31, 2007.

*Primary Examiner* — Kyle Grabowski
(74) *Attorney, Agent, or Firm* — Buchanan Ingersoll & Rooney PC

(57) ABSTRACT

A method of producing a data carrier with a marking is disclosed. The data carrier includes a laser-markable portion and a beam-modifying portion adjacent the laser-markable portion. The beam-modifying portion has a beam modifying property. The method includes irradiating a laser beam through the beam-modifying portion to allow the beam modifying property thereof to modify at least one beam property to produce a resultant laser beam. This resultant laser beam creates a marking with a visual impression corresponding to the resultant laser beam at the laser-markable portion. The method further includes modifying the beam modifying property of at least a part of the beam-modifying portion through which the laser beam is irradiated for creating the marking so that the exact same resultant beam is difficult to be obtained thereat. A data carrier thereby produced is also disclosed.

9 Claims, 4 Drawing Sheets

(56) References Cited

U.S. PATENT DOCUMENTS

| | | | | |
|---|---|---|---|---|
| 6,372,394 | B1 * | 4/2002 | Zientek | 430/10 |
| 7,199,911 | B2 * | 4/2007 | Hudson et al. | 430/10 |
| 2003/0136847 | A1 * | 7/2003 | Braun | 235/487 |
| 2005/0247794 | A1 | 11/2005 | Jones et al. | |
| 2009/0146409 | A1 * | 6/2009 | Lesur | 283/72 |

FOREIGN PATENT DOCUMENTS

| | | | |
|---|---|---|---|
| GB | 2 132 136 | A | 7/1984 |
| WO | WO 98/19870 | A1 | 5/1998 |
| WO | WO 01/29764 | A1 | 4/2001 |

* cited by examiner

METHOD FOR PRODUCING A DATA CARRIER AND DATA CARRIER PRODUCED THEREFROM

TECHNICAL FIELD

This invention relates generally to a method of producing a data carrier with a mark and a data carrier produced thereform. More particularly, this invention relates to a method of producing a data carrier having a laser marking that has a characteristic visual impression that, when completed, is not easily modified without it being detectable and a data carrier that is thus not easily forged or falsified.

BACKGROUND

Data carriers, such as driving licenses, identity cards, membership cards, badges or passes, passports, discount cards, banking cards, money cards, multi-application cards, and other papers of value; and security documents such as bank notes are widely used. Because of the value and importance associated with each of these data carriers, they are often the subject of unauthorized copying and alterations, and forgeries.

To prevent such activities from being carried out on these data carriers, several different types of data carriers have been implemented. One such data carrier is disclosed in U.S. Patent Application No. 2003/0136847, Eckhard Braun, entitled "Method for producing laser-writable data carriers and Data Carrier produced according to this method". This document discloses a data carrier that includes a laser-markable layer and a uniform transparent optically-variable layer overlapping therewith, at least in certain areas of the laser-markable layer. This optically-variable layer is not easily detached without damaging or destroying the laser-markable layer therebelow. Visually perceptible markings are inscribed in the laser-markable layer with a laser beam. Some of these markings are inscribed with the laser beam irradiated through the optically-variable layer located thereabove. The laser beam is selected such that the optically-variable layer is transparent to the laser radiation and is not altered by the laser irradiation. The laser beam is also not modified by the optically-variable layer. The laser beam intensity is, however, sufficiently strong to produce energy that is absorbed in the laser-markable layer so that the irradiated areas of the laser-markable layer undergo a color change and form visually well perceptible markings. These markings include personal data, such as name, date of birth, address, personnel number, serial number, signature, portrait, national emblems, insignias, logos etc.

The markings produced by laser inscription are dark or black so that the radiation passing through the optically variable layer is largely or completely absorbed. Therefore, the optically variable effect observable in reflected light of the optically variable layer located above the markings is especially evident in the area of the markings, while the optically variable layer hardly appears in the surroundings of the markings, in particular against a light or white background. Although such a data carrier is, to a certain extent, protected against copying, forgery and manipulation, it can nevertheless still be manipulated. Additional markings may be laser inscribed after the legitimate markings have been inscribed. Such additional laser inscribing makes it possible to falsify the portrait or data by adding new features to the legitimate markings.

It is therefore desirable to produce data carriers with elevated protection against forgery and manipulation using a method that is simple and cost effective.

DESCRIPTION OF THE INVENTION

According to an aspect of the present invention, there is provided a general method of producing a data carrier with a marking. The data carrier includes a laser-markable portion and a beam-modifying portion adjacent the laser-markable portion. The beam-modifying portion may be abutting the laser-markable portion. Alternatively, the beam-modifying portion may be offset from the laser-markable portion or it may be separated from the laser-markable portion by another translucent or transparent portion. The beam-modifying portion has a beam-modifying property. A laser beam is irradiated through the beam-modifying portion to allow the beam modifying property thereof to affirmatively modify at least one beam property. This modifying of the beam property produces a resultant laser beam that creates a marking with a distinctive visual impression corresponding to the resultant laser beam at the laser-markable portion. The method includes modifying the beam modifying property of at least a part of the beam-modifying portion through which the laser beam is irradiated for creating the marking. This modification of the beam modifying property ensures that the exact same resultant beam is difficult to obtain thereat. Features that are added to the marking by laser irradiation through this part of the beam-modifying portion will not bear the distinctive visual impression. It is therefore possible to determine if any feature is subsequently added to the marking in the data carrier after it is completed.

The beam modifying property of the beam-modifying portion includes any property of the beam-modifying portion that is able to modify any one of the size, intensity, direction, positioning, etc. of the laser beam. For example, the laser beam may be scattered, diffracted which includes bending, spreading and interfering, dispersed and/or distorted when it is irradiated through the beam-modifying portion having the beam modifying property. In some embodiments, the beam modifying property is a physical property of the beam-modifying portion. For example, the beam-modifying portion may have bubbles or particles therein that may modify the laser beam to produce the resultant laser beam. After the marking has been created, the bubbles may be removed, or the size of the bubbles or the orientation, concentration, density of the particles may be modified so that the exact same resultant laser beam obtained before for creating the marking is difficult to be reproduced. That is, the physical property of the beam-modifying property is modifiable to obtain different resultant laser beams.

According to other embodiments, the beam modifying property relates to a geometric property or profile of the beam-modifying portion, such as surface undulations and smoothness, thickness of the layer, etc. According to some embodiments, the laser-markable portion is a laser-markable layer and the beam-modifying portion is a beam-modifying layer opposing and overlapping the laser-markable layer. The laser-markable layer may be separate from the beam-modifying layer with the two layers fixedly attached to each other. According to some embodiments, the beam-modifying layer includes a proximal surface abutting the laser-markable layer and a distal surface facing away from the laser-markable layer. The distal surface has a surface profile that has or exhibits the beam modifying property. The distal surface includes a plurality of raised surface portions that define the surface profile. In one specific embodiment, each of the raised surface portions is semi-circular in cross section. Raised surface portions of other cross-sectional shapes, such as triangular, trapezoidal, rectangular, etc. are also possible. Irregularly shaped raised portions, such as that obtained from the surface of a coin may also be used. According to other embodiments, especially those made of polycarbonate, the laser-markable layer and the beam-modifying layer are laminated to form an integral layer where the two separate layers are molecularly bonded together. In other words, after lamination there is only a single layer with no clear distinction between the laser-markable layer and the beam-modifying layer. In the above-mentioned embodiments, the beam-modifying layer is an at least translucent layer, preferably a transparent layer. For the embodiments described so far, the laser-markable layer may be a translucent, transparent or opaque layer. However, the laser-markable portion and the beam-modifying portion may be different parts of one and the same layer. In such a case, the single layer should be translucent or transparent.

In embodiments where there are raised surface portions, the beam-modifying layer may be a laminating layer. In such a case, the method may further include embossing the distal surface of the laminating layer to obtain the raised surface portions. Furthermore, in these embodiments, the beam modifying property of at least a part of the distal surface may be modified by at least partially removing at least some of the raised surface portions thereat. In some cases, the raised surface portions are not partially removed but completely removed by planarizing the at least one portion of the distal surface to leave a flat surface thereat. The raised portions may be removed by mechanical means such as laser ablation, machining, or especially in the case of a laminating layer, by heating the layer to a molten state so that it becomes soft and pliable and pressing against the at least a part of the distal surface to flatten it. The raised portions may also be removed by other means, for example chemical means. To change the surface profile, it is also possible to add additional matter to the surface.

According to another aspect of the present invention, there is provided a general data carrier. The general data carrier includes a laser-markable portion having a marking created by a laser beam that is irradiated through and modified by a beam-modifying property of a beam-modifying portion disposed adjacent the laser-markable portion. The data carrier further includes a portion in place of and at the position of at least a part of the beam-modifying portion wherein the exact same beam modifying property of the beam-modifying portion is absent thereat. As mentioned above, in some embodiments, the laser-markable portion may be a laser markable layer and the beam-modifying portion may be a beam-modifying layer opposing and overlapping the laser-markable layer. The beam-modifying layer includes a proximal surface abutting the laser-markable layer and a distal surface facing away from the laser-markable layer. In these embodiments, the beam-modifying layer may include the distal surface having a first surface profile that defines the beam modifying property. In such a case, modifying the beam-modifying property of at least a part of the distal surface includes changing the first surface profile on the part of the distal surface to a second surface profile that is different from the first surface profile. In some embodiments, the distal surface of the beam-modifying layer may include a plurality of raised surface portions on the first surface area thereof that define the surface profile. In one embodiment, the second surface area is at least substantially flat.

In one embodiment, the surface profile may be one for creating changeable laser images (CLI). After the images are created, the surface is planarized. For subsequent viewing of the changeable laser images during authentication, a separate sheet having that surface profile may be used.

Accordingly, the data carrier includes a laser-markable portion below a first transparent portion. The laser-markable portion includes a marking overlapping the first transparent portion. The marking is created using a modified laser beam. When the laser beam is of 1000 dots per inch (DPI) resolution and not modified, the spots created by the laser beam has a width that is more than 15 μm, for example around 25, 4 μm. When the laser beam is modified, the marking that is created is defined by irregular shaped spots and/or lines having a width of less than 10 μm. That is, the marking created with the modified laser beam includes spots and/or lines having a width that is half or less than half of that created using the unmodified laser beam. The lines or shape border corresponding to transparent portion profile are solid lines and are not made up of overlapping spots. The first transparent portion has physical properties or a geometric profile, which does not correspond or match the marking defined by spots or lines having the width of less than 10 μm. In other words, when a laser beam is irradiated through this first transparent portion, this first transparent portion does not allow a marking having a width of 10 μm or less to be created in the laser-markable portion thereunder. In some embodiments, the irregular shaped spots and/or lines have a width of less than 0.01 μm. The marking may define any shape or pattern. Other optional markings defined by spots of 25.4 μm width may be created. The data carrier may further include a second transparent portion overlapping the marking. The second transparent portion has physical properties or a geometric profile that is different from that of the first transparent portion.

BRIEF DESCRIPTION OF DRAWINGS

The invention will be better understood with reference to the drawings, in which.

DETAILED DESCRIPTION OF AN EMBODIMENT

Figure 1:
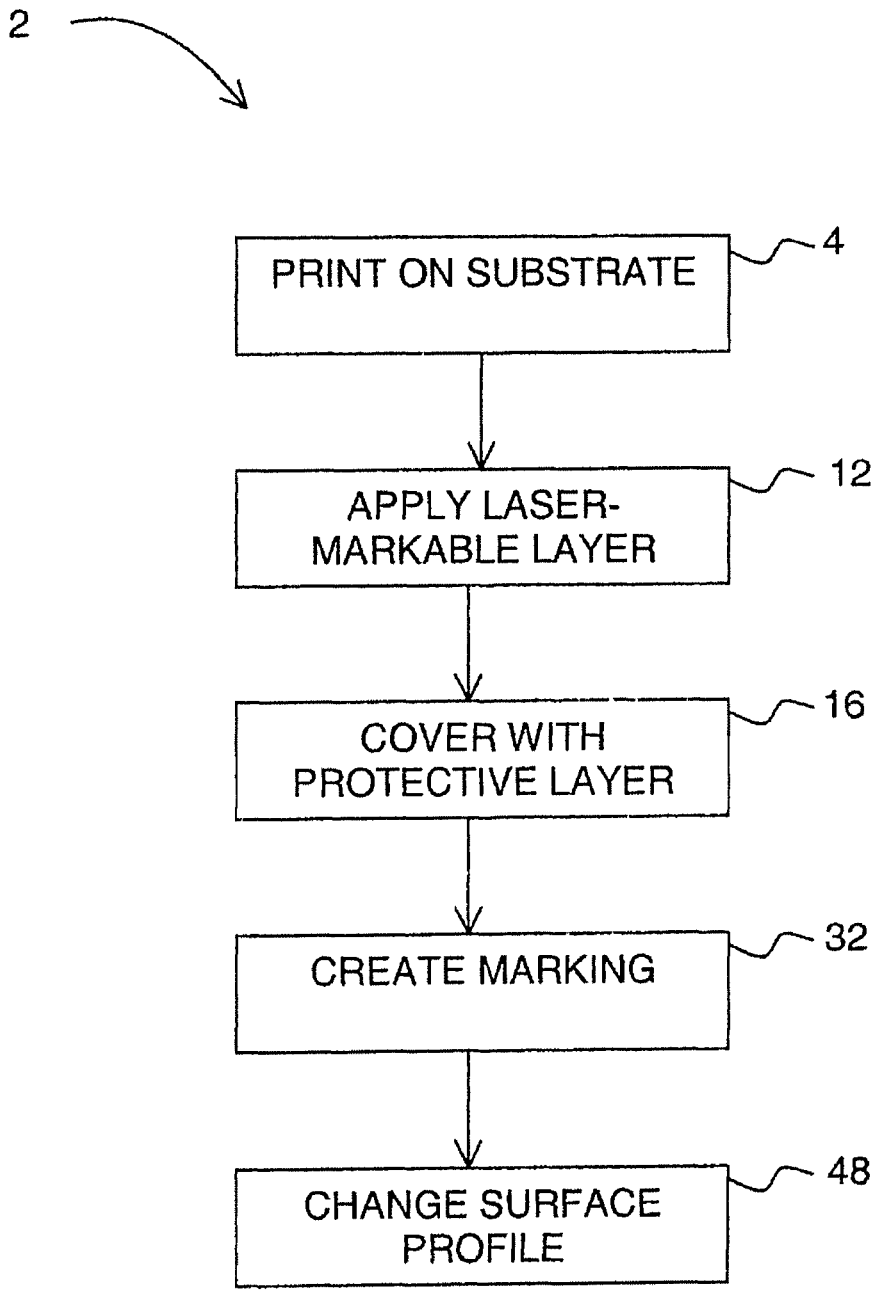
FIG. 1 is a flow diagram showing a sequence of steps, according to an embodiment of the invention, for producing a data carrier with a mark.

As shown in the drawings for purposes of illustration, the invention is embodied in a method of producing a data carrier and a data carrier produced using the method. The data carrier includes a laser-markable portion and a beam-modifying portion adjacent or over the laser-markable portion. A laser beam is irradiated through the beam-modifying portion to create a marking at the laser-markable portion. According to one embodiment, the laser-markable portion is a laser-markable layer and the beam-modifying portion is a beam-modifying protective layer opposing and overlapping the laser-markable layer.

The method according to the embodiment of the invention includes irradiating the laser-markable layer with a laser beam, through the protective layer, to allow the beam modifying property of the protective layer to modify at least one beam property of the laser beam. This modifying of the beam property produces a resultant laser beam that creates a marking with a distinctive visual impression corresponding to the resultant laser beam at the laser-markable layer. The method further includes modifying the beam modifying property of at least a part of the protective layer through which the laser beam is irradiated for creating the marking. This modification of the beam modifying property ensures that the exact same resultant beam is difficult to be obtained thereat.

Hereafter, an embodiment of the present invention will be described in the context of an identity (ID) card and a method for producing it. However, it is to be understood that the invention is usable with any data carrier that includes a laser marking as a verifiable mark of authentication. Such a data carrier includes, but is not limited to, a driving license, a badge or pass, a passport, a discount card, a membership card, a banking card, a credit card, a money card, a multi-application card, and other security documents and papers of value that are to be provided with information or data in such a way that they cannot be easily imitated by common means and are also protected from attempted manipulation.

Figure 2A:
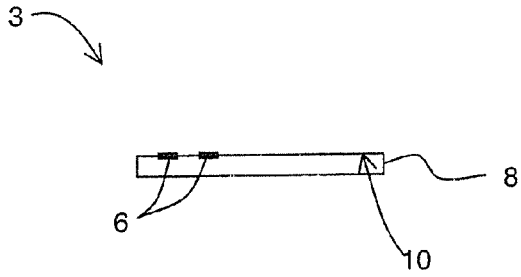
FIG. 2A is a cross-sectional drawing of a data carrier, the data carrier is shown including only a substrate layer at this stage.
Figure 2B:
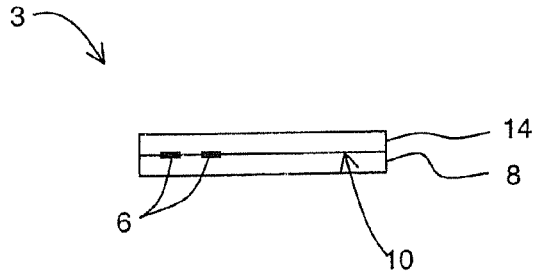
FIG. 2B is a cross-sectional drawing of the data carrier, the data carrier is shown including a laser-markable layer on the substrate layer of FIG. 2A.
Figure 2C:
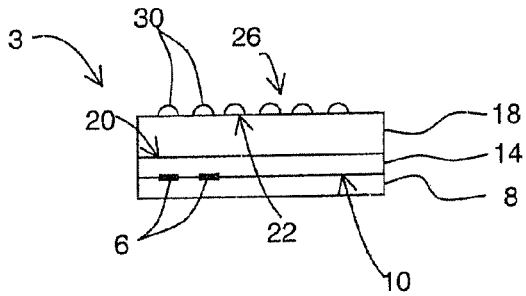
FIG. 2C is a cross sectional drawing of the data carrier, the data carrier is shown including a protective layer on the laser-markable layer of FIG. 2B, the protective layer having raised surface portions.
Figure 2D:
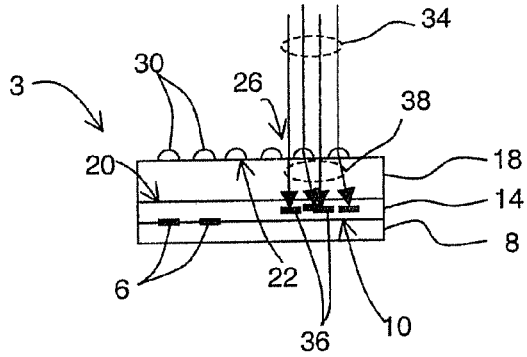
FIG. 2D is a cross sectional drawing of the data carrier similar to that in FIG. 2C, further showing a laser beam used to create a marking in the laser-markable layer.
Figure 2E:
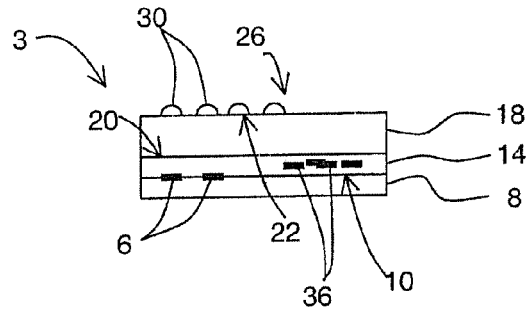
FIG. 2E is a cross sectional drawing of the data carrier similar to that in FIGS. 2C and 2D, further showing some of the raised surface portions in FIG. 2C after the others are removed.

FIG. 1 shows a sequence 2 of steps for producing an identity (ID) card 3 (a completed card is shown in FIG. 2E). The method starts in an optional PRINT ON SUBSTRATE step 4. In this PRINT ON SUBSTRATE step, non-personalized information 6 is printed on a surface 10 of the substrate 8 fabricated of plastic film materials customary in card application, such as Polycarbonate (PC), Polyethylene terephthalate (PET) and Polyvinyl chloride PVC, etc. This non-personalized information 6 may include, but not limited to, a serial number and a national emblem. FIG. 2A shows the substrate 8 with the non-personalized information 6 imprinted thereon.

Next the sequence 2 proceeds to an APPLY LASER-MARKABLE LAYER step 12. In this step 12, a laser-markable layer 14 is fixedly attached to the printed surface 10 of the substrate 8 using for example adhesive, thermal bonding, ultra-sonic bonding or the like. This laser-markable layer may be fabricated of clear polycarbonate with carbon particles. Other materials, such as PET and PVC may also be used so long as they are able to absorb the energy of a laser beam for creating a marking thereat. Detachment of this laser-markable layer 14 after it has been fixedly attached to the substrate 8 will damage the printed information on the substrate 8. FIG. 2B shows the substrate 8 with the laser-markable layer 14 fixedly attached thereto.

The sequence 2 next proceeds to a COVER WITH LAMINATING SHEET step 16. In this step 16, a laminating sheet 18, acting as a protective layer, is fixedly attached to the laser-markable layer 14, as shown in FIG. 2C, to protect the laser markable-layer 14 and the substrate 8 from environmental influences, mechanical damage and abrasion, or alteration. The laminating sheet 18 includes a proximal surface 20 abutting the laser-markable layer 14 of the ID card 3 and a distal surface 22 facing away from the substrate 8. The laminating sheet 18 is fabricated of clear PC, PET, PVC, or any suitable material. In such a case, an exposed surface of the laser-markable layer 14 is laminated with the laminating sheet 18 using a laminating plate having a patterned contacting surface (both not shown). A layer of adhesive (not shown) may be used between the laminating sheet 18 and the laser-markable layer 14 to fixedly attach the two layers 14, 18 to each other. The attachment of the two layers 14, 18 preferably renders the laminating sheet 18 undetachable from the laser-markable layer 14. Additional adhesive layers (not shown), in particular hot melt adhesive layers, can optionally be provided to improve the adhesion between the individual layers 8, 14, 18. For PC layers, it is possible to laminate the layers together without the use of adhesive. The thickness of each layer may be in the range of thirty to hundreds of microns as long as the total thickness of the ID card does not exceed that specified in the standards, for example, the ISO standards.

The patterned contacting surface of the laminating plate when brought into contact with the exposed distal surface 22 of the laminating sheet 18, for example during lamination of PC layers, creates a corresponding embossed pattern 26 on the distal surface 22 to define a surface profile. This embossing produces raised surface portions 30 with a semi-circular cross-section on the distal surface 22 that define the surface profile. These raised surface portions 30 are fine relief structures whose geometrical parameters of spacing, orientation and profile shape are able to change the beam property of a laser beam irradiated therethrough. The raised surface portions 30 are spaced apart on the distal surface 22 and of a height that is in the range of 0.01 to 0.3 mm, preferably in the range of 0.05 to 0.1 mm which is the height range of surface irregularities or profile on the surface of a coin.

The thermal properties of the substrate 8, the laser-markable layer 14 and the laminating sheet 18 are selected such that only the laser-markable layer 14 is affected by a selected laser without the substrate 8 and the laminating sheet 18 being irreversibly affected or destroyed.

The sequence 2 next proceeds to a CREATE MARKING step 32 for creating markings at the laser-markable layer 14, wherein a laser beam 34 is irradiated through the laminating sheet 18 to create at least one marking 36 at the laser-markable layer, as shown in FIG. 2D. This marking 36 includes, but is not limited to, personalized information and data, such as name, date of birth, address, personnel number, signature, portrait, etc.

A laser light source which includes a laser and also an optical system (all not shown) which is necessary for beam guidance and beam focusing is used to generate the laser beam 34. The laser beam 34 may be controlled by a control device, for example a computer (not shown). The laser beam has a spot width of about 25.4 μm. Lasers of other spot widths may also be used.

The power density of the laser beam 34 and the local exposure time of ID card 3 are predetermined in such a way that on the one hand the laser-markable layer 14 is so greatly heated and thereby discoloured that the information and data are formed thereat, and that on the other two layers 8, 18 are not damaged or destroyed by the heating effect. That is, the laser-markable layer 14 has a high degree of absorption of the laser energy in the region of the wavelength of the laser light so that the laser beam 34 predominantly heats and discolours that laser-markable layer 14.

During creation of the marking 36, the control device controls the laser beam 34 so that it passes through the laminating sheet 18 which is transparent in respect thereto to be focused onto the laser-markable layer 14 to cause local discolouration thereat, under the effect of released thermal energy. That is, the discolouration may be on the surface of the laser-markable layer 14 or within the volume of the laser-markable layer 14. Alternatively, if the laser-markable layer contains pigments, reagents or known component sensitive to the laser light, such as titanium oxide, the laser beam 34 will cause reactions with these pigments, reagents or known components to form the marking 36 at the laser-markable layer 14.

The control device optionally includes a system (not shown) for detecting the xy-position of the ID card 3 so that the position of the laser beam 34 can be exactly oriented to the xy-position of the ID card 3. That permits the marking 36 to be applied to the laser markable layer 14 of the ID card 3 in accurate register relationship.

The raised surface portions 30 modify the laser beam 34 to produce a resultant laser beam 38. The laser beam 34 is modified by deviation and/or dispersion. The marking 36 formed by this resultant laser beam 38 has a distinctive visual impression corresponding to the resultant laser beam 38. An illustrative marking will be described shortly. The marking 36 are not accessible from the ID card surface since they are produced in the interior of the ID card 3. Since the lamination sheet 18 and the laser markable layer 14 are translucent or transparent, the personalized laser marking 36 as well as non-personalized print data is readily viewable and recognizable to a viewer.

After the marking 36 is created, the sequence 2 ends in a CHANGE SURFACE PROFILE step 48. In this step 48, the surface profile of at least a part of the distal surface 22 through which the laser beam 34 is irradiated for creating the marking 36 is modified so that the exact same resultant beam 38 is difficult to be obtained thereat. For the embodiment with the raised surface portions 30, modifying the surface profile may be the partial or complete removal of the raised surface portions 30. Partial removal of the raised surface portions 30 would change the shape of the raised surface portions 30, while a complete removal of the raised surface portions 30 would flatten the surface. Flattening of the surface could for example be carried out by using a hot tool (not shown) to heat the laminating sheet 18 to a molten or soften state of the laminating sheet 18. Thereafter, a flat surface of the hot tool is used to planarize or flatten the part of the distal surface 22 so that the laser beam 34 irradiated therethrough will not be able to create a marking bearing the distinctive visual impression since the exact same resultant beam 38 can no longer be obtained. Any modification of the laser markings 36 is thus visible to the naked eye.

Figure 3:
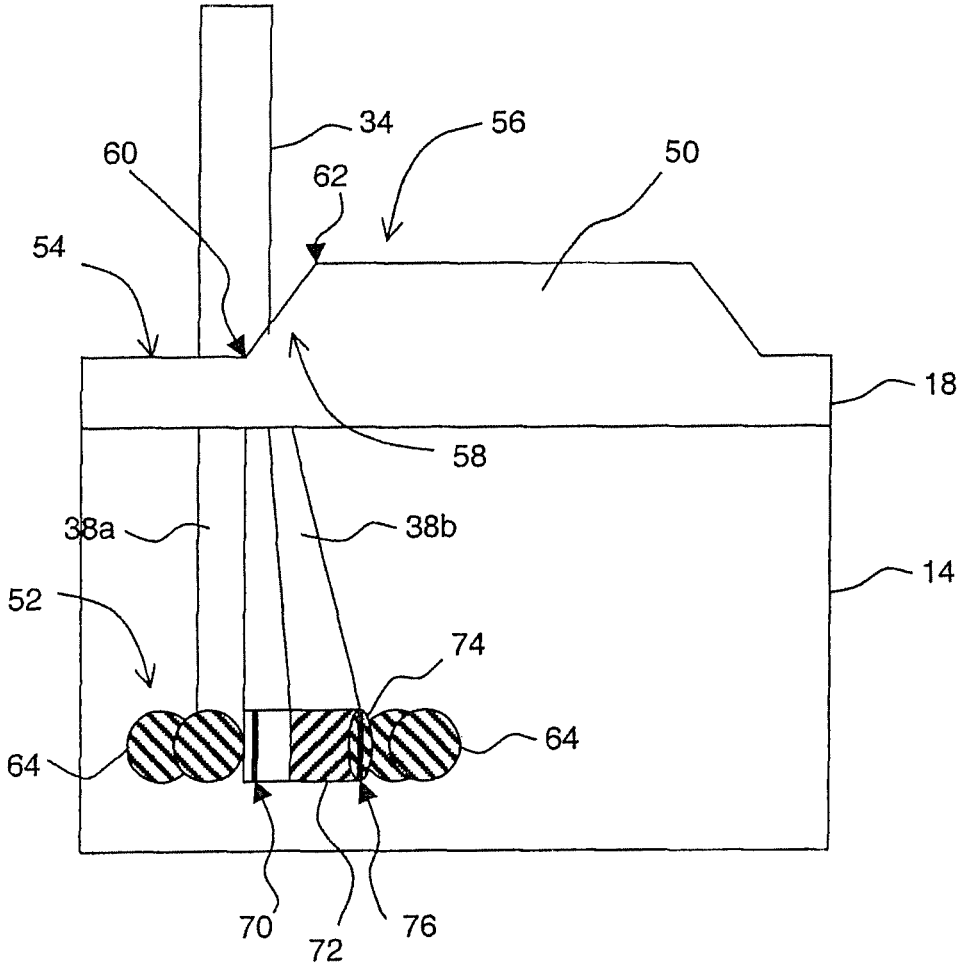
FIG. 3 is a drawing showing an illustrative marking that is created with a laser beam irradiated through one side of a trapezoidal raised surface portion.

According to one embodiment, the raised surface portion 50 may be trapezoidal in cross-section. FIG. 3 shows an illustrative visually distinctive marking 52 that may be created by irradiating the laser beam 34 through this trapezoidal raised surface portion 50 on a laminating layer 18. The laminating layer 18 thus includes a thin portion 54, a thick portion 56 and a sloping portion 58 connecting the thin portion 54 and the thick portion 58. The intersection of the thin portion 54 and the sloping portion 58 defines a first edge 60. Similarly, the intersection of the sloping portion 58 and the thick portion 56 defines a second edge 62. When the laser beam 34 is irradiated through the thin and the thick portions 54, 56, discoloured spots 64 that are not deformed are created at the laser-markable layer 14 since the path of the laser beam 34 is not substantially modified. However, when the laser beam 34 is moved across the edges 60, 62 and the sloping portion 58, the marking 52 created at the laser-markable layer 14 undergoes changes to define at least three characteristic marks. The spots 64 and the three characteristic marks are shown in FIG. 3 as they would have been seen in the laser-markable layer 14 in the direction of arrow A in that figure. The first edge 60 causes a fine line 70 to be created at the laser-markable layer 14. This fine line 70 constitutes a first characteristic mark of the marking 52.

The portion 38*b* of the laser beam 34 deviated by the sloping portion 58 causes the creation of a second characteristic mark 72 that is visually different from the round spots 64. This second characteristic mark 72 has the appearance of an irregular shaped spot. The intersection between the sloping portion 58 and the thick portion 56 causes the third characteristic mark 74 to be created. This third characteristic mark 74 is the result of a combination of a spot 64 obtained as a result of irradiating the laser beam 34 through the thick portion 56 and of the second characteristic mark 72 that is created when the laser beam is deviated by the sloping portion 58. This third characteristic mark 74 has the appearance of a squashed spot and further includes a second distinct line 76 as a result of the second edge 62 on the laminating layer 18. The succession of these three individual characteristic marks 70, 72, 74 is also a characteristic of the marking 52. With a laser beam spot width of about 20 or 25, 4 μm (i.e. about 1000 DPI resolution), the two lines 70 and 76 can have a width of 10 μm or less.

With careful selection of the profile of the raised surface portion 50, lines of width equal or less than 1 μm for part of the marks or 0.1 μm for other part or 0.01 μm for other part of the marks are achievable. These widths of the spots and lines are namely half or less than half the spot width of the laser beam 34. In some cases, spot laser is spread in many spots having a size corresponding to the one obtainable with a laser resolution of more than 2000 DPI. In other cases, lines with above width are obtainable depending of the transparent portion profile.

Figure 4A:
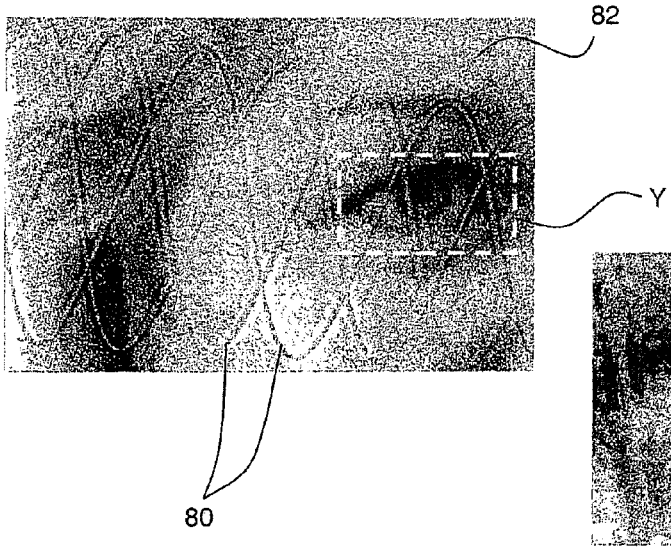
FIG. 4A is a drawing of a data carrier according to another embodiment showing a portrait marking created at the laser-markable layer using a laser beam irradiated through raised guilloche lines on a surface of a protective layer.
Figure 4B:
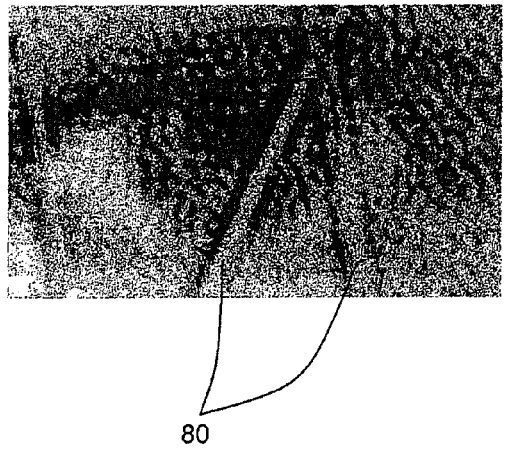
FIG. 4B is an enlarged drawing of a portion Y of FIG. 3A.
Figure 5:
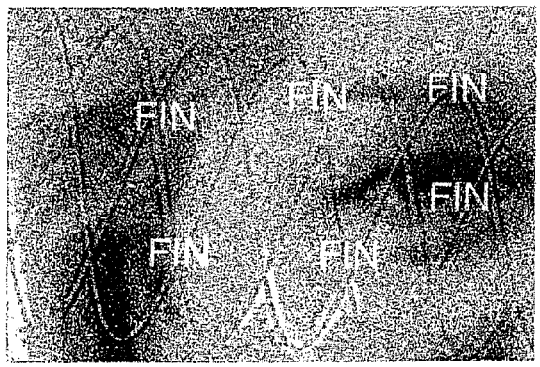
FIG. 5 is a drawing of the data carrier of FIG. 4A showing areas where the raised guilloche lines are flattened to form the word "FIN" on the protective layer.

As another embodiment shown in FIGS. 4A, 4B and 5, instead of raised surface portions 30, 50, raised guilloche lines 80 are formed on the surface of the laminating sheet 18 instead. These raised guilloche lines 80 modify the laser beam 34 that is used to create the portrait image 82 at the laser-markable layer 14. These guilloche lines 80 may be in the form of a logo or any decorative pattern. After the portrait 82 is formed, appropriate parts of the raised guilloche lines 80 may be flattened, for example to form the acronym "FIN" on the surface of the laminating sheet 18.

Advantageously, the ID card 3 that is produced is substantially protected against forgery and manipulation. The ID card has an effective copy protection since distinctive visual impression of the laser marked information and data cannot be rendered by common reproduction methods, such as photocopying and prints with conventional inks. Additionally, the process for manufacturing the ID card is simple, requiring little modification to the current process and equipment. The laminating plates that are currently used for security purposes and for making changeable laser image (CLI) lenses can be easily modified for embossing the laminating sheet. These laminating plates can be used for thousands of lamination cycles for producing tens of thousands of ID cards. These laminating plates are cheap.

Although the present invention is described as implemented in the above described embodiment, it is not to be construed to be limited as such. Other materials, for example, papers or plastic materials of different surface nature, such as photographic papers, passes, documents, value-bearing papers, checks, any support having a transparent layer or film with or without data etc. may also be used as the substrate.

As another example, the substrate need not be a separate layer but can be integral with the laser-markable layer. In such a case, the substrate is a self-supporting laser markable layer, which preferably, is fabricated of plastic and can be sensitized by the admixture of small quantities of substances that are strongly absorbent for the wavelength of the laser beam.

As yet another example, the non-personalized information and data that is described to be printed on the substrate may also be laser marked together with the personalized information/data at the laser-markable layer. The non-personalized information and data may also include company logos, insignias of rank, etc. The personalized information and data may also include a fingerprint and an iris scan.

As yet another example, the laser markable layer may also be a transparent sheet of coating including pigments sensitive to the laser or made up of several superimposed layers of different coloured pigments.

As yet a further example, instead of having raised surface portions defining the surface profile of the laminating sheet, other surface irregularities and/or imperfections such as that created by sand-blasting, etc. may be used.

The invention claimed is:

1. A method of producing a data carrier with a marking, wherein the data carrier includes a laser-markable portion and a beam-modifying portion adjacent or over the laser-markable portion, the beam-modifying portion having a first optical property capable of modifying a laser beam according to a first manner, the method comprising:

a marking step of irradiating a laser beam through the beam-modifying portion to allow the modifying of the laser beam according to the first optical property to produce a resultant laser beam that creates a marking with a visual impression corresponding to the laser beam modified according to the first manner at the laser-markable portion;

wherein:

the method further comprises, after the marking step, a modification step of modifying the beam-modifying property of at least a part of the beam-modifying portion through which the laser beam was irradiated for creating the marking so that the beam-modifying portion has a second optical property different from the first optical property in such a way that it is no longer possible to obtain exactly a laser beam modified according to the first manner at the laser-markable portion.

2. A method according to claim 1, wherein the beam-modifying portion comprises:

a surface having a surface profile that creates the first optical property and the second optical property after the modification step.

3. A method according to claim 2, wherein the surface comprises a plurality of raised surface portions that define the surface profile.

4. A method according to claim 2, wherein:

the beam-modifying portion comprises a laminating layer fixedly attached to the laser-markable portion, and the method further comprises embossing an exposed surface of the laminating layer to obtain the surface profile corresponding to the first optical property.

5. A method according to claim 4, wherein the modification step modifies the beam-modifying property by at least partially removing at least some of the raised surface portions.

6. A method according to claim 5, wherein at least partially removing at least some of the raised surface portions comprises completely removing at least some of the raised surface portions by planarizing the surface.

7. A method according to claim 6, wherein planarizing comprises:

heating the beam modifying portion to soften it; and pressing against the at least one part of the surface of the beam-modifying portion to flatten it.

8. A method according to claim 3, wherein:

the beam-modifying portion comprises a laminating layer fixedly attached to the laser-markable portion, and the method further comprises embossing an exposed surface of the laminating layer to obtain the surface profile corresponding to the first optical property.

9. A method according to claim 1, wherein the beam-modifying portion comprises a portion having bubbles therein and modifying the beam modifying property comprises removing the bubbles.

* * * * *